US006315625B1

(12) United States Patent
Braud

(10) Patent No.: US 6,315,625 B1
(45) Date of Patent: Nov. 13, 2001

(54) KEEL MOUNTED TURRET

(75) Inventor: Jean Braud, La Turbie (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/445,739

(22) PCT Filed: Jun. 9, 1998

(86) PCT No.: PCT/EP98/03663

§ 371 Date: Feb. 1, 2000

§ 102(e) Date: Feb. 1, 2000

(87) PCT Pub. No.: WO98/56650

PCT Pub. Date: Dec. 17, 1998

(30) Foreign Application Priority Data

Jun. 10, 1997 (EP) ..... 97201749

(51) Int. Cl.[7] ..... B63B 22/02; B63B 21/00

(52) U.S. Cl. ..... 441/5; 114/230.12

(58) Field of Search ..... 114/230.12, 256; 441/5

(56) References Cited

U.S. PATENT DOCUMENTS

| | | | | |
|---|---|---|---|---|
| 3,590,407 | * | 7/1971 | Bratianu et al. | 114/256 |
| 5,025,742 | | 6/1991 | Urdshals . | |
| 5,237,948 | | 8/1993 | Hvide . | |
| 5,266,061 | | 11/1993 | Poldervaart et al. . | |
| 5,305,703 | | 4/1994 | Korsgaard . | |
| 5,346,314 | | 9/1994 | Perratone et al. . | |
| 5,755,607 | * | 5/1998 | Boatman et al. | 441/5 |

FOREIGN PATENT DOCUMENTS

| | | |
|---|---|---|
| 0 259 072 | 3/1988 | (EP) . |
| 2 150 517 | 7/1985 | (GB) . |
| 2 150 964 | 7/1985 | (GB) . |
| WO 96/14237 | 5/1996 | (WO) . |

* cited by examiner

*Primary Examiner*—S. Joseph Morano
*Assistant Examiner*—Andy Wright
(74) *Attorney, Agent, or Firm*—Young & Thompson

(57) ABSTRACT

A vessel (1) includes a relatively small sized turret (2) located near keel level. The upper part (3) of the turret wall is located below a level halfway between deck level (12) and keel level (7). Via a relatively small diameter product shaft (9), the product pipe (18) which connects to a riser (17) extends up to deck level (12). The lower part (6) of the turret wall extends along the height of the chain table (8), which is connected thereto via an axial and a radial bearing (23, 24). In this way the chain table (8) can adequately take up the bending moments exerted by the mooring chains (13) or cables. After use of the vessel (1) as a floating production storage and offloading vessel, the lower part (6) of the turret wall can be easily removed and the vessel (1) can be converted back to a transport tanker. Preferably the lower part (6) of the turret wall is releasably connected to the upper part (3) by means of releasable bolts (27) through the upper slide bearings (23) of the chain table (8).

12 Claims, 2 Drawing Sheets

KEEL MOUNTED TURRET

BACKGROUND OF THE INVENTION

The invention relates to a vessel comprising a turret extending vertically within the hull of the vessel, the turret having a cylindrical turret wall with an upper part and a lower part and an annular attachment element which is rotatingly connected to the lower part of the turret wall for the connection of one or more anchor lines for mooring the vessel to the sea bed, the lower part of the turret wall being located at or near keel level, wherein the upper part of the turret wall is located at a position which is below the level halfway between deck level and keel level.

From U.S. Pat. No. 5,266,061 a vessel is known comprising a large diameter turret wall that extends from deck level vertically downwards into a moon pool located near keel level. Within the fixed turret wall, a lower turret section is rotatingly connected. The lower turret section comprises a chain table which is connected to the sea-bed in a geostationary manner. Risers, which extend from a sub-sea structure such as a well head, enter the turret through the chain table and extend into a central shaft extending up to deck level, the central shaft being rotatable together with the chain table within the turret wall. During weathervaning of the vessel, the outer turret wall will rotate together with the vessel around the geostationary chain table, the lower part of the turret and the central shaft accommodating the product pipes.

Providing a large diameter turret wall inside the vessel, the diameter of which may amount up to between 15 and 20 meters, is an extensive operation which may cause a structural weakening of the vessel and which requires separate reinforcements. Futhermore, once a vessel is provided with such a large turret construction for conversion of a tanker to a floating production, storage and offloading vessel (FPSO), it can not easily be rebuilt and brought back into its original state as a transport tanker.

From U.S. Pat. No. 5,237,948 a vessel is known comprising a mooring system. Herein the chain table is fixed to a rigid shaft connected to the hull of the vessel. The chain table is rotatably supported on a flange on the shaft. This construction has as a disadvantage that the known chain table will be susceptible to bending moments which can be directly transferred to the bearings.

SUMMARY OF THE INVENTION

It is an object of the present invention to provide a relatively simple weathervaning construction on a vessel for connecting to a sub-sea oil structure during hydrocarbon exploration activities, which can be relatively easily converted back to its original state. It is a further object of the present invention to provide a vessel with a turret construction which is of low cost, and which can be easily accessed during installation and on conversion. It is another object of the present invention to provide a weathervaning mooring construction which has a large resistence against bending moments.

Thereto a vessel according to the present invention is characterised in that a shaft extends from at least the upper part of the turret wall towards deck level for accommodating a product pipe which is connected to a sub sea structure, the diameter of the shaft being substantially smaller than the diameter of the turret wall, wherein the lower part of the turret wall extends along substantially the whole height of the annular attachment element, the attachment element being supported by an upper and a lower bearing, one of the bearings being an axial bearing, the other bearing being a radial bearing.

By providing a relatively short turret wall within the lower half of the vessel, a relatively simple structure is formed which can during hydrocarbon exploration effectively function as a turret structure, and which can be easily installed and removed from the vessel. As the topmost part of the weathervaning construction is formed by the shaft with a relatively small diameter for accommodating the product pipes, relatively little structural weakening of the vessel occurs, and little useful storage space inside the vessel is occupied. As the annular attachment element, such as a chain table according to the present invention is along its full length supported by the turret wall by means of an axial and a radial bearing, a structure is obtained which can adequately take up the bending moments exerted by the mooring chains or cables, without the risk of deformation of the bearings and subsequent failure of the chain table to rotate. After use of the vessel for hydrocarbon exploration, for instance when the hydrocarbon well has been depleted, the part of the turret wall close to keel level can be removed, for instance by cutting through the turret wall, but preferably by means of a releasable coupling. Preferably the lower part of the turret wall extends below keel level such that the attachment element, such as a chain table, can be easily accessed for installation or removal. It is however possible to accommodate the chain table completely within a recess in the hull of the vessel, such that it is projecting below the outer circumference of the vessel.

Preferably the height of the turret wall is relatively small and the upper part is located relatively close to keel level, such as at a distance of between 0.1 and 0.5 times the distance between keel level and deck level. The diameter of the shaft substantially corresponds with the diameter of at least one product pipe for allowing rotational movement of the product pipe within the shaft. Near deck level, the product pipe is connected to a swivel which connects a horizontal product pipe in a rotatable manner to the product pipe extending in the shaft of the vessel. It is however also possible to mount the swivel near or at the turret position by lowering the swivel through the shaft from deck level. In that case the diameter of the shaft is made large enough to accommodate the swivel.

In a preferred embodiment of the vessel according to the present invention, the turret wall comprises an upper and a lower bearing, each bearing having a radially extending flange with an axial bearing surface and an axially extending part forming a radial bearing surface, the axially extending part of the upper bearing being fixedly connected to the lower part of the turret wall, the radially extending flange of the upper bearing being fixedly connected to upper part of the turret wall, the flange and the axially extending part of the upper bearing being mutually connected in a releasable manner.

By decoupling the upper bearing part, for instance by means of bolts, the lower part of the turret according to the invention including the attachment element can be easily be moved. With the releasable bearings according to the invention it is also possible to exchange the lower part of the turret for instance after damage to the chain table, or for use with a differently configured chain table that is adapted to specific operating conditions at different locations.

BRIEF DESCRIPTION OF THE DRAWINGS

An embodiment of the vessel according to the present invention will be explained in detail with reference to the accompanying drawings. In the drawings.

DESCRIPTION OF THE PREFERRED EMBODIMENTS

Figure 1:
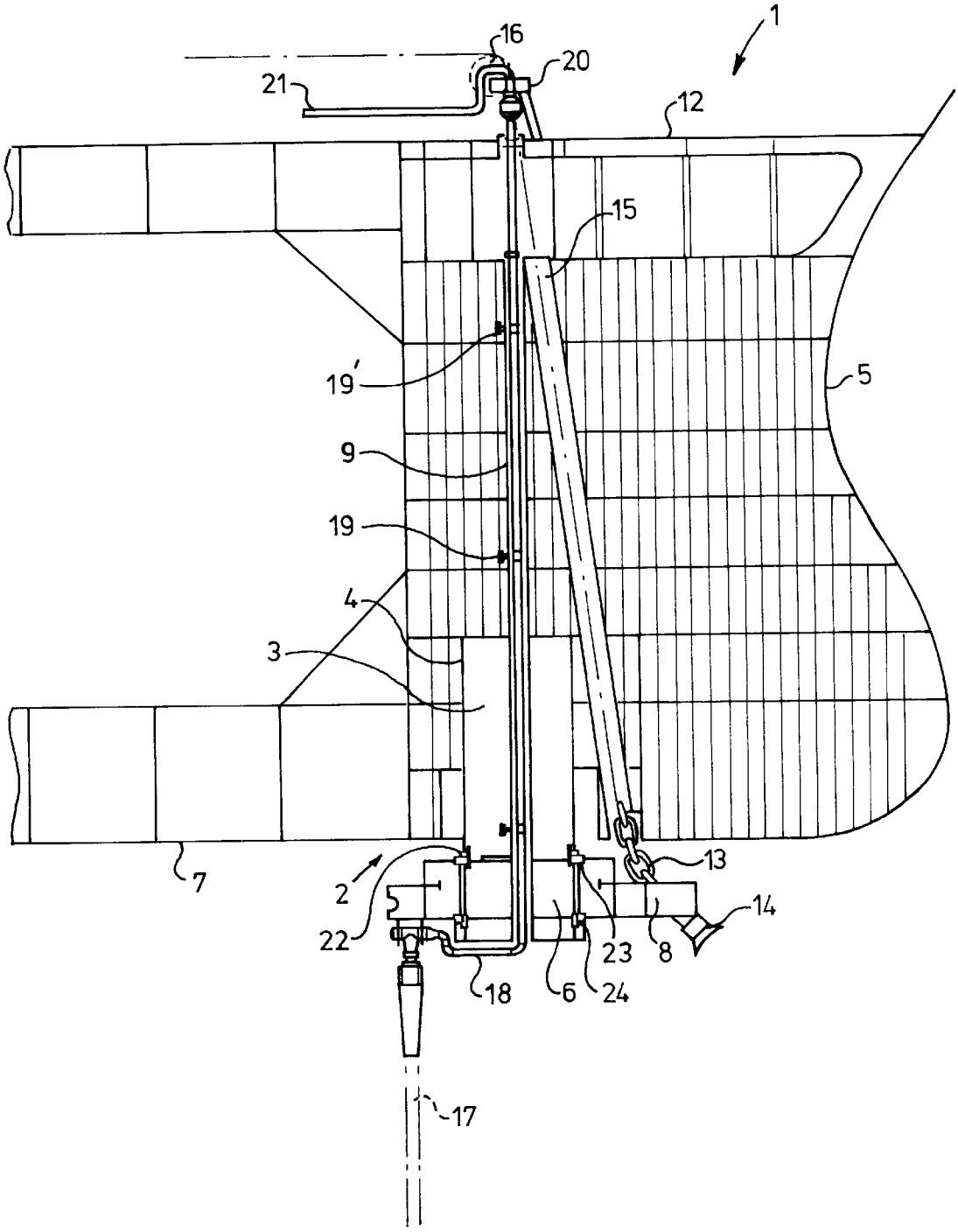
FIG. 1 shows a partly cross-sectional view of a vessel comprising a turret according to the present invention and FIG. 2 shows a detail of the bearings of the upper and lower parts of the turret of FIG. 1.

FIG. 1 shows a vessel 1 which near its bow is provided with a turret 2. The turret 2 comprises an upper part 3 comprising a cylindrical turret wall 4 which extends in a vertical direction within the hull 5 of the vessel. The lower part 6 of the turret 2 is located below keel level 7 and comprises an attachment element or chain table 6. A vertical shaft 9 extends through the upper and lower parts 4,6 of the turret vertically upwards through the vessel towards deck level 12. In a preferred embodiment, the shaft 9 consists of an upper and a lower shaft part that are connected to each other by means of a coupling near the turret 2. This coupling has not been shown in the drawing.

An anchor chain 13 is connected to the chain table 8 via a chain stopper 14. The end of the anchor chain 13 is connected to a cable running through the chain pull tube 15 and being guided via a sheave 16 to a chain installation winch (which is not shown in the drawing). The other end of the anchor chain 13 is connected to the sea-bed via an anchor or an anchoring pile. A riser 17 is connected to the chain table 8 and is connected to a product pipe 18. The product pipe 18 extends within the shaft 9, the diameter of which is only slightly larger than the diameter of the product pipe. The product pipe 18 is positioned within the shaft 9 by means of pipe guides 19,19' located along the length of the shaft 9. At deck level 12, the product pipe 18 is connected to a swivel 20. It is however also possible that the swivel 20 is mounted below deck level 12, for instance at or near the position of the turret 2. Via a rotating ring of the swivel the geostationary product pipe 18, around which the shaft 9 can rotate, is connected to horizontal product pipes 21 on the deck of the vessel 1. The diameter of the turret wall 4 is about 4 m. The diameter of the shaft 9 is about 60 cm. The distance between deck level and keel level is about 25 m.

The upper part 3 of the turret 2 extends one third of the height between keel level 7 and deck level 12 into the vessel 1. The lower part 6 of the turret 2 is releasably connected to the upper part 3 by means of coupling means 22. The coupling means 22 are part of the upper bearings 23 of a pair of axial and radial bearings 23,24 between the turret wall 4 and the rotating chain table 8. Although the coupling means 22 in FIG. 1 are shown to project below keel level 7, it is preferred that they are located above keel level, such that after detaching the lower part 6 of the turret wall 4, no parts project from below the vessel 1. The details of the bearings 23,24 are shown in FIG. 2.

Figure 2:
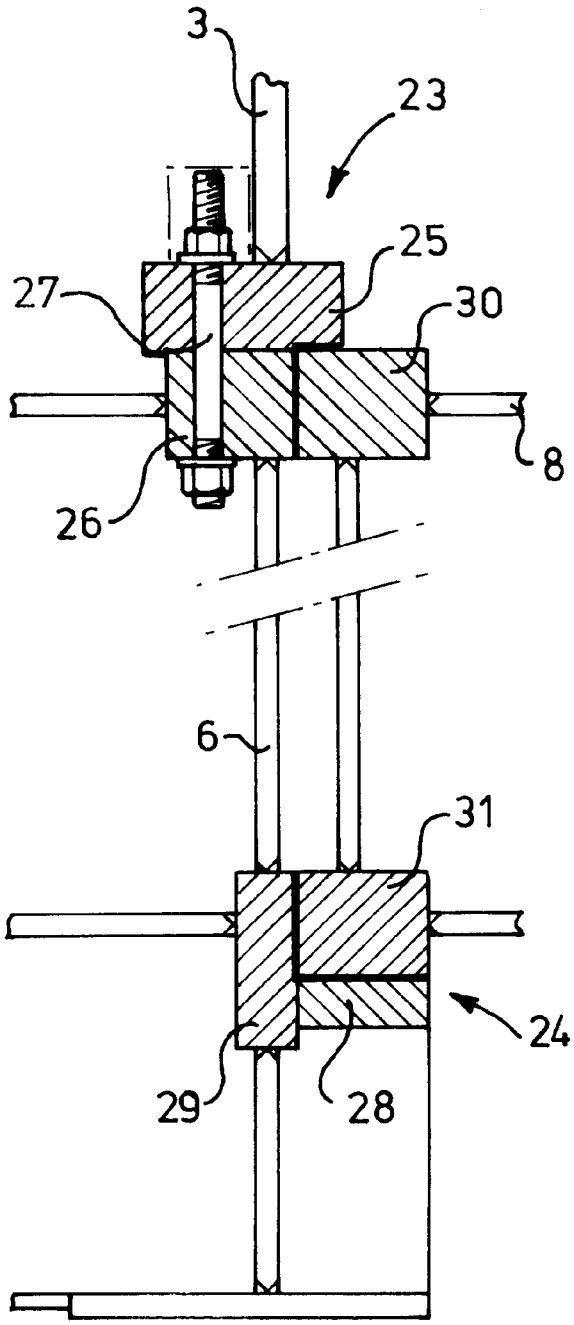

As can be seen in FIG. 2, the upper part 3 of the turret wall is provided with a bearing 23 comprising a flange 25 and a radial support ring 26. The flange 25 of the upper bearing 23 is welded to the upper part 3 of the turret wall 4. The radial support ring 26 is welded to the lower part 6 of the turret wall. The flange 25 and the ring 26 are releasably connected by means of bolts 27. The lower bearing 24 comprises a flange 28 and a radial support ring 29 which are connected in a non-detachable way. The outer axial and radial surfaces of the bearings 24,25 are provided with a low friction coating or low friction pads to form axial and radial slide bearings for the bearing rings 30,31 of the chain table 8.

What is claimed is:

1. Vessel comprising:

a turret extending vertically within a hull of the vessel, the turret having a fixed cylindrical turret wall with an upper part and a lower part and an annular attachment element which is rotatingly connected to the lower part of the turret wall for the connection of one or more anchor lines for mooring the vessel to a sea bed, the lower part of the turret wall being located at or near keel level, the upper part of the turret wall being located at a position which is below the level halfway between deck level and keel level; and a shaft extending from at least the upper part of the turret wall towards deck level for accommodating a product pipe which is connected to a sub sea structure, a diameter of the shaft being substantially smaller than a diameter of the turret wall, the lower part of the turret wall extending along substantially the whole height of the annular attachment element, an upper part of the attachment element being supported by an upper bearing, adjacent to an upper surface of the attachment element a lower part of the attachment element being supported by a lower bearing, adjacent to a lower surface of the attachment element one of the upper and lower bearings being an axial bearing, the other of the upper and lower bearings being a radial bearing.

2. Vessel according to claim 1, wherein the lower part of the turret wall extends below keel level.

3. Vessel according to claim 2, wherein the diameter of the shaft is smaller than 0.5 times the diameter of the turret wall.

4. Vessel according to claim 1, wherein the diameter of the shaft is smaller than 0.5 times the diameter of the turret wall.

5. Vessel according to claim 1, wherein a distance of the upper part of the turret wall from keel level is between 0.1 and 0.5 times the distance between keel level and deck level.

6. Vessel according to claim 1, wherein the diameter of the shaft substantially corresponds with the diameter of the product pipe for allowing a relative relational movement of the product pipe with respect to the shaft.

7. Vessel according to claim 1, wherein the lower part of the turret wall is releasably connected to the upper part of the turret wall.

8. Vessel according to claim 7, wherein the turret wall comprises coupling means located near keel level connecting the upper and the lower parts of the turret.

9. Vessel according to claim 8, wherein each of the upper and lower bearings has a radially extending flange with an axial bearing surface and an axially extending part forming a radial bearing surface, the axially extending part of the upper bearing being fixedly connected to the lower part of the turret wall, the radially extending flange of the upper bearing being fixedly connected to upper part of the turret wall, the flange and the axially extending part of the upper bearing being mutually connected in a releasable manner.

10. Vessel according to claim 1, wherein the upper bearing is directly adjacent to an uppermost surface of the attachment element and the lower bearing is directly adjacent to a lowermost surface of the attachment element.

11. Vessel according to claim 1, wherein the upper and lower bearings are spaced apart in a direction generally parallel to a longitudinal axis of the turret.

12. Vessel comprising:

a turret extending vertically within a hull of the vessel, the turret having a cylindrical turret wall with an upper part and a lower part and an annular attachment element which is rotatingly connected to the lower part of the turret wall for the connection of one or more anchor lines for mooring the vessel to a sea bed, the lower part of the turret wall being located at or near keel level, the upper part of the turret wall being located at a position which is below the level halfway between deck level and keel level; and a shaft extending from a least the upper part of the turret wall towards deck level for accommodating a product pipe which is connected to a sub sea structure, a diameter of the shaft being substantially smaller than the diameter of the turret wall, the lower part of the turret wall extending along substantially the whole height of the annular attachment element, the attachment being supported by an upper and lower bearing, one of the bearings being an axial bearing, the other bearing being a radial bearing, the lower part of the turret wall being releasably connected to the upper part of the turret wall, wherein each of the upper and lower bearings has a radially extending flange with an axial bearing surface and an axially extending part forming a radial bearing surface, the axially extending part of the upper bearing being fixedly connected to the lower part of the turret wall, the radially extending flange of the upper bearing being fixedly connected to upper part of the turret wall, the flange and the axially extending part of the upper bearing being mutually connected in a releasable manner.

* * * * *